US009982375B2

(12) United States Patent
Yoshida et al.

(10) Patent No.: US 9,982,375 B2
(45) Date of Patent: May 29, 2018

(54) THERMOCOMPRESSION-BONDING FILAMENT NONWOVEN FABRIC HAVING EXCELLENT MOLDING PROPERTIES

(71) Applicant: Toyobo Co., Ltd., Osaka (JP)

(72) Inventors: Hideo Yoshida, Shiga (JP); Hiroyuki Sakamoto, Shiga (JP); Naofumi Minagawa, Yamaguchi (JP); Takashi Koida, Osaka (JP)

(73) Assignee: Toyobo Co., Ltd., Osaka (JP)

( * ) Notice: Subject to any disclaimer, the term of this patent is extended or adjusted under 35 U.S.C. 154(b) by 314 days.

(21) Appl. No.: 14/439,753

(22) PCT Filed: Oct. 31, 2013

(86) PCT No.: PCT/JP2013/079525

§ 371 (c)(1),
(2) Date: Apr. 30, 2015

(87) PCT Pub. No.: WO2014/069562

PCT Pub. Date: May 8, 2004

(65) Prior Publication Data

US 2015/0345054 A1 Dec. 3, 2015

(30) Foreign Application Priority Data

Nov. 2, 2012 (JP) ..... 2012-242624

(51) Int. Cl.

| | |
|---|---|
| ***D04H 1/54*** | (2012.01) |
| ***D04H 3/147*** | (2012.01) |
| ***D04H 5/06*** | (2006.01) |
| ***D04H 3/011*** | (2012.01) |
| ***D04H 3/14*** | (2012.01) |
| ***D01F 6/92*** | (2006.01) |

(52) U.S. Cl.

CPC ..... *D04H 1/54* (2013.01); *D01F 6/92* (2013.01); *D04H 3/011* (2013.01); *D04H 3/14* (2013.01); *D04H 3/147* (2013.01); *D04H 5/06* (2013.01); *D10B 2321/08* (2013.01); *D10B 2331/04* (2013.01); *D10B 2505/12* (2013.01)

(58) Field of Classification Search

CPC . D04H 1/54; D04H 3/147; D04H 5/06; D10B 2331/04; D10B 2331/08; D10B 2505/12

See application file for complete search history.

(56) References Cited

U.S. PATENT DOCUMENTS

| | | | |
|---|---|---|---|
| 2006/0121813 | A1 | 6/2006 | Kobayashi et al. |
| 2007/0117489 | A1 | 5/2007 | Yamamoto et al. |
| 2008/0038980 | A1 | 2/2008 | Tanaka et al. |

FOREIGN PATENT DOCUMENTS

| | | |
|---|---|---|
| JP | 9-11818 | 1/1997 |
| JP | 2006-009214 | 1/2006 |
| JP | 2006-160237 | 6/2006 |
| JP | 2007-020787 | 2/2007 |
| JP | 2011-000792 | 1/2011 |
| WO | 2005/059220 | 6/2005 |
| WO | 2012/173104 | 12/2012 |

OTHER PUBLICATIONS

A computerized English translation to JP 2011-000792 to Takashi et al. (Jan. 6, 2011) obtained from EPO website.*

Japanese Patent Office, International Search Report for International Patent Application PCT/JP2013/079525, dated Dec. 17, 2013.

* cited by examiner

*Primary Examiner* — Jeremy R Pierce

(74) *Attorney, Agent, or Firm* — Fish & Richardson P.C.

(57) ABSTRACT

Provided is a thermocompression-bonding filament nonwoven fabric, which is inexpensive, has excellent molding properties and design properties, and is suitable as surface materials for automotive acoustic absorbing materials. The thermocompression-bonding filament nonwoven fabric comprising a polyester-based resin having a melting point of 250° C. or more, wherein the filament nonwoven fabric has a weight of 20 to 80 g/m$^2$, a sum of 5% tensile loads in a MD and CD per weight of 1.0 to 1.9 (N/5 cm)/(g/m$^2$), and a 180° C. dry heat shrinkage of 3.5% or less in both the MD and CD, and is not mechanically interlaced.

4 Claims, No Drawings

THERMOCOMPRESSION-BONDING FILAMENT NONWOVEN FABRIC HAVING EXCELLENT MOLDING PROPERTIES

TECHNICAL FIELD

The present invention relates to a thermocompression-bonding filament nonwoven fabric having excellent molding properties and suitable for use as surface materials for automotive acoustic absorbing materials. In more details, the present invention relates to a thermocompression-bonding filament nonwoven fabric that makes easy integral molding of surface materials for protecting core materials, that has reduced breaks of embossed marks after molding and that has less fluffing.

BACKGROUND ART

Acoustic absorbing materials integrally made from a nonwoven fabric layered at least on one side of glass fiber mats, urethane chips, and the like processed by binder resins such as phenol resins are now available (see, for example, Patent Document 1). To improve the covering properties of the acoustic absorbing materials, the fluffing resistance and design properties of the surface need to be imparted by increasing the fiber content of nonwoven fabrics in the surface layer or increasing the fiber compression bonding rate in thermocompression bonding.

However, although the covering properties may be improved by increasing fiber compression bonding rate, the forming processability decreases since the constituent mutual fibers are elongated or displaced largely in hot press forming process. Furthermore, that arises another problem of high cost due to productive inefficiency since the time for the forming process would be prolonged.

Acoustic absorbing materials including needle-punched nonwoven fabrics (see, for example, Patent Document 2) have weak interfiber bundling and thus good formability. However, there is a problem that decrease the operability since it is difficult that such acoustic absorbing materials are hold by a pin tenter, which is used for binder processing to impart fire retardancy, and water and oil repellency. Furthermore, that arises another problem of high cost due to many manufacturing processes.

Thermocompression-bonding filament nonwoven fabrics are characterized by low cost due to reduced manufacturing processes, and strong interfiber bundling through fiber compression bonding. Thus, it leads to poor molding properties. The molding properties can be improved to some extent by processing at weak compression bonding after changing the heating temperature and pressure condition during embossing. However, such nonwoven fabrics still suffer from the tendency of fluffing due to breaks or partial breaks of embossed marks provided as design properties. In addition to this, there is a technique to allow constituent fibers to be easily stretched by reducing the spinning speed in the manufacture of nonwoven fabrics to reduce the molecular orientation of constituent fibers. This technique, however, has a problem to tend to lose the evenness of webs to form spots or to increases the shrinkage of constituent fibers to generate shrinkage spots during molding.

PRIOR ART DOCUMENTS

Patent Documents

Patent Document 1: JP-A-H09-11818
Patent Document 2: JP-A-2006-160237

SUMMARY OF THE INVENTION

Problems to be Solved by the Invention

The present invention has been made in consideration of the problems in conventional techniques. That is, an object of the present invention is to provide a thermocompression-bonding filament nonwoven fabric, which is inexpensive, has excellent molding properties and design properties, and is suitable as surface materials for automotive acoustic absorbing materials.

Solutions to the Problems

The present inventors have intensively studied to solve the problems and as a result, finally completed the present invention. Specifically, the present invention is as follows.

(1) A thermocompression-bonding filament nonwoven fabric comprising a polyester-based resin having a melting point of 250° C. or more, wherein the filament nonwoven fabric has a weight of 20 to 80 g/m$^2$, a sum of 5% tensile loads in a MD and CD per weight of 1.0 to 1.9 (N/5 cm)/(g/m$^2$), and a 180° C. dry heat shrinkage of 3.5% or less in both the MD and CD, and is not mechanically interlaced.

(2) The thermocompression-bonding filament nonwoven fabric according to (1), wherein the polyester-based resin comprises 2.0 wt % or less of a styrene-methyl methacrylate-maleic anhydride copolymer or styrene-maleic acid copolymer in polyethylene terephthalate.

(3) The thermocompression-bonding filament nonwoven fabric according to (1) or (2), having an apparent density of from 0.12 to 0.20 g/cm$^3$.

Effects of the Invention

Automotive acoustic absorbing surface materials, which includes the thermocompression-bonding filament nonwoven fabric of the present invention, have better molding properties and design properties after molding than those of ones including thermocompression-bonding filament nonwoven fabrics known in the prior arts. Thus, the thermocompression-bonding filament nonwoven fabric of the present invention may be suitably used as the surface materials for automotive acoustic absorbing materials.

MODE FOR CARRYING OUT THE INVENTION

The present invention relates to a thermocompression-bonding filament nonwoven fabric which includes a constituent fiber made of a polyester-based resin having a melting point of 250° C. or more being a common thermoplastic resin inexpensive and excellent in mechanical properties, and is used as the surface materials for automotive acoustic absorbing materials. The polyester-based resin having a melting point of 250° C. or more to be used as a material of the constituent fiber in the nonwoven fabric of the present invention is preferably a resin mainly composed of polyethylene terephthalate (hereinafter referred to as "PET"). Polyolefin-based materials typically exemplified by polyethylene and polypropylene are not preferred because of lower heat resistance and fire retardancy than those of PET.

The polyester-based resin having a melting point of 250° C. or more to be used in the present invention is preferably a resin having a glass transition temperature of 80° C. or less, more preferably a resin having a glass transition temperature of 70° C. or less. The polyester-based resin is preferably a resin containing 98.0 wt % or more of PET and optionally containing other resin within 2.0 wt %. The resin to be mixed is exemplified by, for example, thermoplastic polystyrene-based copolymers. Of these copolymers, a styrene-methyl methacrylate-maleic anhydride copolymer and a styrene-maleic acid copolymer are preferred. In the present invention, modifiers, such as an antioxidant agent, light resisting agent, colorant, antibiotic, and fire retardant, may be optionally added unless such modifiers degrade the properties.

The weight of the thermocompression-bonding filament nonwoven fabric of the present invention is from 20 to 80 g/m$^2$, preferably from 25 to 70 g/m$^2$, more preferably from 30 to 60 g/m$^2$. The weight of less than 20 g/m$^2$ causes the drop-off of glass wool through nonwoven fabrics when integral molding with a core material containing glass wool and the like, and impairs the function of coating, which is the intended purpose. The weight of more than 80 g/m$^2$ adversely affects the mold conformability, since, even if the temperature and compression bonding are controlled, the nonwoven fabric is hard due to its high weight.

In the thermocompression-bonding filament nonwoven fabric of the present invention, the sum of the 5% tensile loads in the machine direction (MD) and in the cross machine direction (CD) per weight is from 1.0 to 1.9 (N/5 cm)/(g/m$^2$), preferably from 1.3 to 1.8 (N/5 cm)/(g/m$^2$). The sum of the 5% tensile loads of less than 1.0 (N/5 cm)/(g/m$^2$) tends to break embossed patterns due to insufficient emboss compression and to cause fluffing, whereas the sum of more than 1.9 (N/5 cm)/(g/m$^2$) makes the nonwoven fabric too hard to degrade the molding properties.

The 180° C. dry heat shrinkage of the thermocompression-bonding filament nonwoven fabric of the present invention is 3.5% or less, preferably 3.2% or less, more preferably 3.0% or less in both the MD and CD. The 180° C. dry heat shrinkage of more than 3.5% results in size-shortage when preheating before molding and thus fails to keep the molding area.

The thermocompression-bonding filament nonwoven fabric of the present invention is not subjected to mechanical interlacing, such as needle punching and stream interlacing, but subjected only to embossing with an engraved roll and a flat roll. Mechanical interlacing is suitable for providing the molding properties because of weak interfiber bundling. Such mechanical interlacing, however, there is a problem that the operability is decreased since it is difficult that such acoustic absorbing materials are hold by a pin tenter, which is used for binder processing to impart fire retardancy, and water and oil repellency. Furthermore, that arises another problem of high cost due to many manufacturing processes.

The apparent density of the thermocompression-bonding filament nonwoven fabric of the present invention is from 0.12 to 0.20 g/cm$^3$, preferably from 0.12 to 0.19 g/cm$^3$. The apparent density of less than 0.12 g/cm$^3$ tends to break embossed patterns due to insufficient emboss compression and to cause fluffing. The apparent density of more than 0.20 g/cm$^3$ makes the nonwoven fabric too hard to degrade the molding properties.

The specific gravity of the fiber constituting the thermocompression-bonding filament nonwoven fabric of the present invention is from 1.30 to 1.38, preferably from 1.34 to 1.38, more preferably from 1.36 to 1.378. The specific gravity of less than 1.30 results in a low degree of crystallinity of the fiber so that it causes shrinkage during heating molding. The specific gravity of more than 1.38 results in a high degree of crystallinity of the fiber to adversely affect the mold conformability when molding.

The fineness of the constituent fiber in the thermocompression-bonding filament nonwoven fabric of the present invention is preferably form 0.5 to 5 dtex, more preferably from 1 to 4 dtex, still more preferably from 1.5 to 3.5 dtex. The fineness of less than 0.5 dtex results in a small fiber diameter. Therefore, for producing filament nonwoven fabric having a weight in the above range, the number of fibers to be constituted will be increased. As a result, that causes the state where the fiber might be easily thermocompression-bonded. This increases the initial stress during heating to degrade the mold conformability. Furthermore, that also induces various problems such as fiber breakage, to increase the cost due to deterioration of operability. Since the fineness of more than 5 dtex results in a large fiber diameter. Therefore, for producing nonwoven fabric having a weight in the above range, the number of fibers to be constituted will be decreased. Accordingly, the contact points between fibers are reduced. Therefore, that causes the state where the fibers might not be easily thermocompression-bonded. This imposes adverse effects, such as decrease of design properties and the stand-out of transparency of glass.

In the thermocompression-bonding filament nonwoven fabric according to the present invention, preferably, a compression-bonding fiber assembly part is partially formed by subjecting the nonwoven fabric to thermocompression bonding with a pair of hot rolls during manufacturing to satisfy the molding properties and design properties. More preferably, one of the pair of hot rolls is engraved. When the pair of hot rolls both are engraved rolls, the compression bonding is too strong to achieve the formability.

Furthermore, in the present invention, the compression-bonding fiber assembly part is partially formed, and thermocompression bonding is performed under different conditions from ordinary thermocompression bonding conditions to satisfy the above molding properties and design properties. One engraved roll of the pair of thermocompression-bonding rolls is a thermocompression-bonding roll engraved to have a raised pattern, and the other is a thermocompression-bonding roll having the flat surface. In addition, the followings are required: the temperature of the engraved roll surface is set to from 150° C. to 220° C.; the temperature of the flat roll surface is set to from 100° C. to 180° C.; and furthermore the temperature of the engraved roll surface is higher. Unless the engraved roll surface is set to higher temperature and the flat roll surface is set to lower temperature in the above temperature ranges, nonwoven fabrics having excellent molding properties while having a reduced shrinkage, minimized breaks of embossed marks during molding, and reduced fluffing cannot be obtained. The difference in temperatures between the engraved roll surface and the flat roll surface is more preferably 20° C. or more.

In the thermocompression-bonding filament nonwoven fabric according to the present invention, the compression-bonding area ratio in the dot structure of the compression-bonding fiber assembly part in the nonwoven fabric is preferably from 5 to 30%, more preferably 7 to 25%, still more preferably 10 to 20%. The area ratio of less than 5% may fail to maintain the mechanical properties of the nonwoven fabric, whereas the area ratio of more than 30% may result in strong compression bonding to impair the molding properties.

In the thermocompression-bonding filament nonwoven fabric according to the present invention, the compression-bonding area of the compression-bonding fiber assembly part in the dot structure of the compression-bonding fiber assembly part in the nonwoven fabric is preferably from 0.2 to 4 $mm^2$, more preferably 0.25 to 3 $mm^2$, still more preferably 0.3 to 2 $mm^2$. The compression-bonding area of less than 0.2 $mm^2$ may reduce the effect of fixing the filament to decrease the structure preservation properties. On the other hand, the compression-bonding area of more than 4 $mm^2$ may make the nonwoven fabric hard to impair the molding properties.

In the thermocompression-bonding filament nonwoven fabric according to the present invention, the thickness of the compression-bonding fiber assembly part in the dot structure of the compression-bonding fiber assembly part in the nonwoven fabric is preferably from 5 to 100 μm, more preferably 7 to 50 μm, still more preferably 10 to 30 μm. The thickness of less than 5 μm may cause structural deterioration due to deformation, whereas the thickness of more than 100 μm may decrease the molding properties.

In the thermocompression-bonding filament nonwoven fabric according to the present invention, the thickness ratio of the compression bonding part to the total thickness of the nonwoven fabric is preferably from 2 to 30%, more preferably 3 to 20%, still more preferably 5 to 15%. The thickness ratio of less than 2% may reduce the structural deterioration due to deformation or the function of fiber bundling points, whereas the thickness ratio of more than 30% may make the nonwoven fabric hard to impair the molding properties.

The shape of the partial compression-bonding fiber assembly part as described above is not particularly limited, and preferred examples of shapes include weave pattern, diamond pattern, square pattern, hexagonal pattern, ellipse pattern, lattice pattern, dot pattern, and round pattern.

In the thermocompression-bonding filament nonwoven fabric according to the present invention, the rate of increase in distance of an embossed mark in the MD after 10% elongation in the MD (the mean (n=5) in the area of ±1 cm from the center of the nonwoven fabric that is 10% elongated from the fabric with a width of 5 cm at a chuck distance of 10 cm) is preferably 5% or less, more preferably 4% or less. The rate of increase of more than 5% significantly brakes the embossed mark to generate fluffing and thus degrade the design properties.

In the thermocompression-bonding filament nonwoven fabric according to the present invention, the birefringence (Δn) is preferably set to from 0.04 to 0.15 as the orientation of the filament constituting the nonwoven fabric to satisfy the mechanical properties of the nonwoven fabric. The birefringence (Δn) of less than 0.04 leads to insufficient oriented crystallization with poor strength and elongation and high shrinkage to degrade the stability of the nonwoven fabric properties and thus to generate size defect during molding. On the other hand, ultrahigh-speed spun fibers having a birefringence (Δn) of more than 0.15 contain voids, which reduces the strength and elongation and thus results in weak fabrics, so that nonwoven fabrics have poor mechanical properties. The birefringence (Δn) is more preferably from 0.045 to 0.11, still more preferably from 0.05 to 0.10. In order for the fiber to have a birefringence (Δn) of from 0.05 to 0.10, the spinning speed to achieve the best productivity and also satisfy the mechanical properties is in the range from 3000 to 6000 m/min.

An exemplary method for producing a nonwoven fabric according to the present invention is described below. It should be understood that the present invention is not limited by this disclosure.

Mixed and dried are 99.6 wt % of polyethylene terephthalate having an intrinsic viscosity of 0.63 and 0.4 wt % of a polystyrene-based copolymer, followed by spinning with a melt spinning machine in accordance with an ordinary method. The extrusion rate is set according to the set traction speed to achieve a desired fineness and required orientation. In order to obtain, for example, a fiber with Δn of 0.8 and a fitness of 2.0 dtex, the spinning speed is set to 4500 m/min, and the single hole extrusion rate is set to 0.75 g/min.

A spun extruded filament is attenuated with traction jet located below and solidified while being cooled by cooling air just under a nozzle to 10 cm below. The filament spun by traction is collected on a suction net conveyor located below and processed into a web having a desired nonwoven fabric weight of from 20 to 80 $g/m^2$. The web was next subjected to thermocompression bonding continuously or in a separate process.

In the present invention, the compression-bonding fiber assembly part is partially formed, and thermocompression bonding is performed under different conditions from ordinary thermocompression bonding conditions to satisfy the formability and design properties. That is, one of a pair of thermocompression-bonding rolls is a thermocompression-bonding roll engraved to have a raised pattern, and the other is a thermocompression-bonding roll having the flat surface. It is required to set the engraved roll surface to not less than 150° C. and not more than 220° C., and set the flat roll surface to not less than 100° C. and not more than 180° C. Unless the temperature of the engraved thermocompression-bonding roll surface is higher and the temperature of the other flat roll surface is lower with a desired nonwoven fabric weight, nonwoven fabrics having excellent molding properties with a few breaks of embossed marks after molding and less fluffing cannot be obtained.

In the present invention, the temperature of the engraved roll surface needs to take account of the sheet supply speed in thermocompression bonding. The temperature of the engraved roll surface is preferably from 150 to 220° C., more preferably from 160 to 200° C. at a sheet supply speed of 10 m/min. Furthermore, the temperature of the flat roll surface is preferably from 100 to 180° C., more preferably from 120 to 150° C. at a sheet supply speed of 10 m/min.

The linear pressure of the compression bonding with such thermocompression-bonding rolls is preferably from 10 to 40 kN/m.

The thermocompression-bonding filament nonwoven fabric obtained by thermocompression bonding under the above conditions has excellent molding properties with a few breaks of embossed marks after molding and less fluffing.

In the present invention, the compression-bonding area ratio of the partial compression-bonding fiber assembly part is preferably from 5 to 30%, thus a dot engraving pattern having 5% to 30% area of the raised compression bonding surface is preferably used. In the present invention, the dot pattern is not particularly limited, but preferred examples of patterns include ellipse pattern, diamond pattern, and texture pattern.

The thermocompression-bonding filament nonwoven fabric of the present invention thus obtained is cut in a predetermined shape, layered with glass wool, and brought into a given molding machine. The resulting material is a surface material having a few creases than conventional surface materials and having excellent molding properties and design properties with a few breaks of embossed marks and less fluffing.

EXAMPLES

Although the present invention will be described in more detail by way of Examples and Comparative Examples, the present invention is not limited to these. The evaluation method used in Examples and Comparative Examples of the present invention was carried out in the following manner.

(1) Melting Point

Five milligrams of a resin sample was obtained and evaluated by measuring the temperature at the endothermic peak as a melting point with Differential Scanning calorimeter (Q100, manufactured by TA Instruments) when the temperature is increased from 20° C. to 300° C. at 10° C./min under a nitrogen atmosphere.

(2) Weight [g/m2]

The weight was measured in accordance with mass per unit area in JIS L 1906 (2000) 5.2.

(3) Thickness [mm]

The thickness was measured at randomly selected 20 points using Constant Pressure Thickness Gauge (manufactured by OZAKI MFG CO., LTD.) with 7 gf/cm$^2$.

(4) Apparent Density [g/cm$^3$]

The apparent density was calculated from the weight and thickness measured in (2) and (3) above according to the following equation.

$$\text{Apparent density}=\text{weight}/(\text{thickness}\times 1000)$$

(5) Sum of 5% Tensile Loads in MD and CD per Weight [(N/5 cm)/(g/m$^2$)]

The stress at 5% tensile load was determined from the data obtained by measuring a sample of depth 50 mm, length 200 mm and width 200 mm to be measured with a tensile testing machine manufactured by Orientec Co., Ltd. in accordance with JIS L-1906 5.3.1 (2000). The sum of the 5% tensile loads in the MD and CD per weight was obtained by calculation.

(6) 180° C. Dry Heat Shrinkage [%]

The 180° C. dry heat shrinkage was obtained before and after heating at 180° C. for 10 minutes in the MD and CD (mean of n=5 for each direction) in accordance with JIS L 1906 (2000) 5.2.

$$\text{Heat shrinkage}=100-(\text{after heating}/\text{before heating}\times 100)$$

(7) Quantitative Analysis of Styrene-Methyl Methacrylate-Maleic Anhydride Copolymer Resin About 10 mg of a sample is dissolved in 0.6 ml of deuterated chloroform/trifluoroacetic acid (volume ratio 85:15), and the 1 H-NMR spectrum is measured in the following conditions.

Apparatus: Fourier transform nuclear magnetic resonance apparatus (spectrometer: AVANCE 500, Bruker BioSpin K.K.; magnet: Oxford Instruments)

1H Resonant frequency: 500.1 MHz

Flip angle of detection pulse: 45°

Data acquisition time: 4.0 seconds

Delay time: 1.0 sec

Integration number: 128 times

Measurement temperature: room temperature (25° C.)

Given that the integral value of the peak for terephthalic acid that appears around 8.1 ppm is A, and the integral value of the peak for the methyl group of methyl methacrylate that appears around 3.7 ppm is B, the content (wt %) of styrene-methyl methacrylate-maleic anhydride copolymer resin is expressed by the following equation.

$$\text{Content (wt \%)}=(B\times 6300)/((A\times 48)+(B\times 63))$$

(8) Fineness [dtex]

The total mean of the diameter (D) of a single fiber was calculated by measuring the diameter of the single fiber at selected randomly five points in a sample (n=20) with an optical microscope. The total mean of the specific gravity (p) of the fiber was calculated by collecting the fiber at the same five points as above and measuring the specific gravity of the fiber (n=5) with a density gradient tube. Next, the fineness [dtex], a fiber weight per 10000 m, was calculated from the mean specific gravity and the single fiber cross-sectional area obtained from the mean single fiber diameter.

(9) Compression-Bonding Area Ratio [%] of Nonwoven Fabric

The fabric was cut in a 30 mm square at randomly selected 20 points, and photographed at 50× magnification with SEM. The photograph was printed in A3 size, and the compression-bonding unit area was cut out to determine the area (S0). Next, only the compression bonding part in the compression-bonding unit area was cut out to determine the area (Sp) of the compression bonding part, and then the compression-bonding area ratio (P) was calculated. The mean of the compression-bonding area ratio P at the 20 points was calculated.

$$P=Sp/S0(n=20)$$

(10) Method for Measuring Specific Gravity

Samples of 5 mm square were provided by cutting at randomly selected four points. A density gradient tube containing calcium nitrate tetrahydrate and pure water was provided. The sample was degassed well and placed in the density gradient tube in which the temperature was controlled at 30° C.±0.1° C. After the sample was allowed to stand for 5 hours, the position of the sample in the density gradient tube was read from the scale of the density gradient tube. The reading (n=4) was converted into the specific gravity on the basis of the calibration graph of density gradient tube scale versus specific gravity with reference to standard glass floats. The specific gravity was obtained by basically reading up to the fourth decimal place and rounding it off to the third decimal place.

(11) Birefringence (Δn)

Each of single fibers is taken out of the nonwoven fabric at randomly selected 20 points as a sample. The fiber diameter and retardation were read (n=5 for each sample) with Nikon polarization microscope OPTIPHOT-POL model, and the birefringence was obtained as the mean of 20 points.

(12) Rate of Increase in Longitudinal Distance of Embossed Mark at 5% Longitudinal Elongation [%]

A sample of longitudinal width (50 mm) and length (200 mm) to be measured was elongated by 5 mm with a tensile testing machine manufactured by Orientec Co., Ltd. with a chuck distance of 100 mm (the center of the sample was positioned at 50 mm from the chucks) at a tension rate of 200 mm/min. The tension was then stopped and the sample was taken out after 10 seconds. The sample was hung with the end being secured with a clip in a room in which the humidity was controlled to 65% at 20° C. After 30 minutes, one embossed dot in the center area (in 1 cm$^2$) of the sample was photographed with SEM to determine the maximum elongation rate in the machine direction according to (the maximum emboss distance in the machine direction after 5% elongation/the maximum emboss distance in the machine direction before 5% elongation−1)×100. The same area was photographed before and after elongation, and the mean of total five measurements (one sheet for each measurement) was obtained as the measured value.

(13) Evaluation on Appearance after Molding

A cut nonwoven fabric sample of 50 cm square and a mat containing 500 g/m$^2$ of glass wool impregnated with a phenolic resin were layered. This layered material was placed in the recesses of an uneven mold symmetrical pattern (opening ϕ 300, bottom ϕ 100, depth 50 mm, clearance 5 mm) and preheated at 180° C. After 30 seconds, the layered material was compressed at an upper and lower mold temperature of 200° C. for 60 seconds. After releasing, the raised surface of the sample was visually evaluated. The sample without fluffing was rated as ○ and the sample with fluffing was rated as x. The rating of creases was performed by observing the recesses of the sample. The sample with five or less creases was rated as ○ and the sample with more than five creases was rated as x.

Example 1

To a spun-bond spinning system, 99.6 wt % of PET having an intrinsic viscosity of 0.63 and 0.4 wt % of a styrene-methyl methacrylate-maleic anhydride copolymer resin (PLEXIGLAS HW 55, hereinafter referred to as HW 55, Rohm GmbH & Co. KG) were added, and subjected to melt spinning at a spinning temperature of 285° C. and a single hole extrusion rate of 0.75 g/min using a nozzle having a nozzle orifice with L/D=3.0. The melt-spun fiber was drawn at a spinning speed of 4500 m/min, and deposited on a net conveyor to form a filament web having a fitness of 1.65 dtex. The filament web was next subjected to temporary compression bonding with a temporary bonding roll and then compressed with an embossing roll having 12% compression-bonding area ratio at an embossing roll surface temperature of 170° C., a flat roll surface temperature of 145° C., and a linear pressure of 30 kN/m to form a filament nonwoven fabric having a weight of 30 g/m$^2$. The physical properties of the resulting nonwoven fabric and the evaluation results are shown in Table 1.

Example 2

A filament nonwoven fabric was prepared in the same manner as in Example 1 except that the speed of the conveyor net was adjusted to form the nonwoven fabric having a weight of 40 g/m$^2$. The physical properties of the resulting nonwoven fabric and the evaluation results are shown in Table 1.

Example 3

A filament nonwoven fabric was prepared in the same manner as in Example 1 except that the speed of the conveyor net was adjusted to form the nonwoven fabric having a weight of 50 g/m$^2$ and the temperatures of the embossing roll and the flat roll were 165° C. and 140° C., respectively. The physical properties of the resulting nonwoven fabric and the evaluation results are shown in Table 1.

Example 4

A filament nonwoven fabric was prepared in the same manner as in Example 1 except that the speed of the conveyor net was adjusted to form the nonwoven fabric having a weight of 80 g/m$^2$ and the temperatures of the embossing roll and the flat roll were 160° C. and 135° C., respectively. The physical properties of the resulting nonwoven fabric and the evaluation results are shown in Table 1.

Comparative Example 1

A filament nonwoven fabric was prepared in the same manner as in Example 1 except that 100 wt % of PET having an intrinsic viscosity of 0.63 was used, the speed of the conveyor net was adjusted to form the nonwoven fabric having a weight of 40 g/m$^2$ and the temperatures of the embossing roll and the flat roll were 220° C. and 220° C., respectively. The physical properties of the resulting nonwoven fabric and the evaluation results are shown in Table 1.

Comparative Example 2

A filament nonwoven fabric was prepared in the same manner as in Comparative Example 1 except that embossing was not performed and only temporary bonding was carried out. The physical properties of the resulting nonwoven fabric and the evaluation results are shown in Table 1.

Comparative Example 3

A filament nonwoven fabric was prepared in the same manner as in Comparative Example 1 except that the temperatures of the embossing roll and the flat roll were 170° C., respectively. The physical properties of the resulting nonwoven fabric and the evaluation results are shown in Table 1.

Comparative Example 4

A filament nonwoven fabric was prepared in the same manner as in Example 3 except that the speed of the conveyor net was adjusted to form the nonwoven fabric having a weight of 70 g/m$^2$. The physical properties of the resulting nonwoven fabric and the evaluation results are shown in Table 1.

Comparative Example 5

A filament nonwoven fabric was prepared in the same manner as in Comparative Example 1 except that the speed of the conveyor net was adjusted and the temperatures of the embossing roll and the flat roll were 170° C. and 150° C., respectively. The physical properties of the resulting nonwoven fabric and the evaluation results are shown in Table 1.

Comparative Example 6

A filament nonwoven fabric was prepared in the same manner as in Comparative Example 1 except that the temperatures of the embossing roll and the flat roll were 160° C., respectively. The physical properties of the resulting nonwoven fabric and the evaluation results are shown in Table 1.

Comparative Example 7

A filament nonwoven fabric was prepared in the same manner as in Comparative Example 1 except that the temperatures of the embossing roll and the flat roll were 150° C., respectively. The physical properties of the resulting nonwoven fabric and the evaluation results are shown in Table 1.

TABLE 1

| Item | | direction | unit | Ex. 1 | Ex. 2 | Ex. 3 | Ex. 4 | Co. 1 | Co. 2 |
|---|---|---|---|---|---|---|---|---|---|
| Production method | PET content rate | — | wt % | 99.6 | 99.6 | 99.6 | 99.6 | 100 | 100 |
| | HW55 content rate | — | wt % | 0.4 | 0.4 | 0.4 | 0.4 | 0 | 0 |
| | Temperature of the embossing roll | — | ° C. | 170 | 170 | 165 | 160 | 220 | — |
| | Temperature of the flat roll | — | ° C. | 145 | 145 | 140 | 135 | 220 | — |
| Physical properties of the nonwoven fabric | Weight | — | $g/m^2$ | 30 | 40 | 50 | 80 | 40 | 40 |
| | Thickness | — | mm | 0.201 | 0.273 | 0.300 | 0.450 | 0.220 | 0.350 |
| | Apparent Density | — | $g/cm^3$ | 0.15 | 0.15 | 0.17 | 0.18 | 0.182 | 0.114 |
| | Specific Gravity (Density gradient tube method) | — | — | 1.37 | 1.38 | 1.38 | 1.38 | 1.39 | 1.35 |
| | 5% Tensile Loads | MD | N/5 cm | 33 | 52 | 65 | 114 | 82 | 2 |
| | | CD | N/5 cm | 8 | 10 | 12 | 15 | 15 | 1 |
| | Sum of 5% Tensile Loads in MD and CD per Weight | — | (N/5 cm)/($g/m^2$) | 1.37 | 1.52 | 1.54 | 1.61 | 2.44 | 0.08 |
| | 180° C. Dry Heat Shrinkage | MD | % | 2.6 | 2.3 | 1.8 | 1.2 | 1.7 | 15.0 |
| | | CD | % | 1.8 | 1.6 | 1.2 | 0.8 | 1.1 | 13.0 |
| | Rate of Increase in Longitudinal Distance of Embossed Mark at 5% Longitudinal Elongation | — | % | 3.9 | 3.2 | 3.0 | 2.8 | 1.2 | — |
| Molding evaluations | Fluffing | — | — | ○ | ○ | ○ | ○ | ○ | Dimensional error |
| | Rating of creases | — | — | ○ | ○ | ○ | ○ | x | Dimensional error |

| Item | | direction | unit | Co. 3 | Co. 4 | Co. 5 | Co. 6 | Co. 7 |
|---|---|---|---|---|---|---|---|---|
| Production method | PET content rate | — | wt % | 100 | 100 | 100 | 99.6 | 99.6 |
| | HW55 content rate | — | wt % | 0 | 0 | 0 | 0.4 | 0.4 |
| | Temperature of the embossing roll | — | ° C. | 170 | 170 | 170 | 160 | 150 |
| | Temperature of the flat roll | — | ° C. | 170 | 170 | 150 | 160 | 150 |
| Physical properties of the nonwoven fabric | Weight | — | $g/m^2$ | 40 | 70 | 40 | 40 | 40 |
| | Thickness | — | mm | 0.300 | 0.450 | 0.340 | 0.240 | 0.270 |
| | Apparent Density | — | $g/cm^3$ | 0.133 | 0.156 | 0.118 | 0.167 | 0.148 |
| | Specific Gravity (Density gradient tube method) | — | — | 1.387 | 1.389 | 1.382 | 1.375 | 1.372 |
| | 5% Tensile Loads | MD | N/5 cm | 21 | 30 | 20 | 67 | 50 |
| | | CD | N/5 cm | 13 | 17 | 3 | 15 | 12 |
| | Sum of 5% Tensile Loads in MD and CD per Weight | — | (N/5 cm)/($g/m^2$) | 0.85 | 0.67 | 0.57 | 2.05 | 1.55 |
| | 180° C. Dry Heat Shrinkage | MD | % | 2.2 | 2.2 | 2.5 | 2.2 | 3.7 |
| | | CD | % | 1.5 | 1.5 | 1.6 | 1.5 | 2.7 |
| | Rate of Increase in Longitudinal Distance of Embossed Mark at 5% Longitudinal Elongation | — | % | 6.7 | 7.0 | 7.0 | 2.2 | 1.2 |
| Molding evaluations | Fluffing | — | — | x | x | x | ○ | Dimensional error |
| | Rating of creases | — | — | ○ | ○ | ○ | x | Dimensional error |

Examples 1 to 4, the thermocompression-bonding filament nonwoven fabrics of the present invention, were acceptable for both fluffing and creases. On the other hand, Comparative Examples 1, and 6, in which the sum of the 5% tensile loads in the MD and CD per weight was large, had reduced fluffing but many creases. For Comparative Example 2 without embossing and Comparative Example 7 with a low embossing temperature, the shrinkage of the resulting nonwoven fabrics was large, and thus the shrinkage during preheating before molding was large, which failed molding because of size defect. Comparative Examples 3, 4 and 5, in which the sum of the 5% tensile loads in the MD and CD per weight was small, had no creases but had increased fluffing.

INDUSTRIAL APPLICABILITY

The thermocompression-bonding filament nonwoven fabric of the present invention is a filament nonwoven fabric that has excellent molding properties and design properties after molding and is suitable for use in surface materials for automotive acoustic absorbing materials, or suitable as nonwoven fabrics to be combined as a cover for protecting core materials, such as glass wool, which makes a large contribution to industrial development.

The invention claimed is:

1. A thermocompression-bonding filament nonwoven fabric comprising a polyester-based resin having a melting point of 250° C. or more, wherein the filament nonwoven fabric has a weight of 20 to 80 $g/m^2$, a sum of 5% tensile loads in MD and CD per weight of 1.0 to 1.9 (N/5 cm)/($g/m^2$), and a 180° C. dry heat shrinkage of 3.5% or less in both the MD and CD, and is not mechanically interlaced.

2. The thermocompression-bonding filament nonwoven fabric according to claim 1, wherein the polyester-based resin comprises a polyethylene terephthalate and from more than 0 wt % to 2.0 wt % of a styrene-methyl methacrylate-maleic anhydride copolymer resin or styrene-maleic acid copolymer resin.

3. The thermocompression-bonding filament nonwoven fabric according to claim 1, having an apparent density of from 0.12 to 0.20 $g/cm^3$.

4. The thermocompression-bonding filament nonwoven fabric according to claim 2, having an apparent density of from 0.12 to 0.20 g/cm$^3$.

* * * * *